US012504242B2

(12) United States Patent
Muska

(10) Patent No.: US 12,504,242 B2
(45) Date of Patent: Dec. 23, 2025

(54) MODULAR LOWER RECEIVER

(71) Applicant: Smith & Wesson Inc., Springfield, MA (US)

(72) Inventor: Simon M. Muska, Enfield, CT (US)

(73) Assignee: Smith & Wesson Inc., Maryville, TN (US)

( * ) Notice: Subject to any disclaimer, the term of this patent is extended or adjusted under 35 U.S.C. 154(b) by 0 days.

(21) Appl. No.: 18/744,915

(22) Filed: Jun. 17, 2024

(65) Prior Publication Data

US 2024/0418461 A1 Dec. 19, 2024

Related U.S. Application Data

(60) Provisional application No. 63/508,426, filed on Jun. 15, 2023.

(51) Int. Cl.
*F41A 3/66* (2006.01)

(52) U.S. Cl.
CPC ..... *F41A 3/66* (2013.01)

(58) Field of Classification Search
CPC ..... F41A 3/66; F41A 11/00; F41A 11/02
See application file for complete search history.

(56) References Cited

U.S. PATENT DOCUMENTS

| | | | | |
|---|---|---|---|---|
| 3,318,192 | A * | 5/1967 | Sullivan | F41A 3/82 89/142 |
| 3,380,183 | A * | 4/1968 | Sullivan | F41A 19/46 42/75.02 |
| 5,513,461 | A | 5/1996 | Weldle | |
| 6,070,354 | A | 6/2000 | Burigana | |
| 7,926,217 | B2 | 4/2011 | McCann | |
| 8,789,305 | B1 | 7/2014 | DiChario | |
| 9,068,786 | B2 | 6/2015 | DiChario | |
| 9,297,599 | B2 | 3/2016 | Underwood et al. | |
| 9,664,465 | B1 | 5/2017 | Viviano | |
| 10,641,563 | B2 | 5/2020 | Song et al. | |
| 10,731,934 | B2 | 8/2020 | Song et al. | |
| 10,767,943 | B2 | 9/2020 | Roberts | |
| 11,385,003 | B1 | 7/2022 | Tasyagan | |
| 11,441,859 | B2 | 9/2022 | Underwood et al. | |
| 2004/0211104 | A1* | 10/2004 | Eberle | F41C 23/14 42/71.02 |
| 2010/0162608 | A1* | 7/2010 | McCann | F41C 23/14 42/71.01 |
| 2013/0091751 | A1* | 4/2013 | Barney | F41C 23/10 42/71.01 |
| 2014/0331535 | A1* | 11/2014 | Robinson | F41A 3/66 42/6 |
| 2019/0301821 | A1* | 10/2019 | Song | F41A 3/66 |

* cited by examiner

*Primary Examiner* — Joshua E Freeman
(74) *Attorney, Agent, or Firm* — Ballard Spahr LLP

(57) ABSTRACT

A lower receiver includes a polymer main body having an outer surface and defining an interior. The interior of the polymer main body defines a first socket. A grip attachment body is receivable, along a first axis, into the first socket of the interior of the polymer main body. The grip attachment body includes a first threaded insert that is configured to receive a fastener for securing a grip to the lower receiver.

18 Claims, 5 Drawing Sheets

MODULAR LOWER RECEIVER

CROSS-REFERENCE TO RELATED APPLICATION

This application claims priority to and the benefit of the filing date of U.S. Provisional Patent Application No. 63/508,426, filed Jun. 15, 2023, the entirety of which is hereby incorporated by reference herein.

FIELD

This disclosure relates to a lower receiver for a firearm.

BACKGROUND

Even though polymer can be lighter and less expensive, lower receivers of firearms such as modern sporting rifles are conventionally made from metal. Various reasons motivate forming the lower receiver from metal instead of polymer. For example, lower receivers include thick sections that form sinks when using injection molding. Lower receivers typically include small, deep holes that would require very small steel tools (e.g., drill bits) that would deflect or even break with use, or would require secondary machining to produce. Lower receivers typically include slide actions on many angles. Normal vector orientation of features would require a slide action for each feature, making a mold expensive and complicated. Lower receivers typically include threaded holes for attachments. While thread-forming slide action tool details can be produced to form threaded features, they are expensive and complicated when creating molds, especially when more than one is required. Lower receivers are subject to impact loads and shear stresses that require use of materials stronger than polymer.

A modular lower receiver comprising polymer components that addresses or overcomes these difficulties is disclosed.

SUMMARY

Aspects of this invention concern a firearm and a lower receiver for a firearm.

In various aspects, a lower receiver includes a polymer main body having an outer surface and defining an interior. The interior of the polymer main body defines a first socket. A grip attachment body is receivable, along a first axis, into the first socket of the interior of the polymer main body. The grip attachment body includes a first threaded insert that is configured to receive a fastener for securing a grip to the lower receiver.

In some aspects, the first socket includes engagement surfaces that are complementary to at least a portion of the grip attachment body.

In one example, the grip attachment body has an outer surface that defines a slot. The first threaded insert is slidably received within the slot along a second axis that is perpendicular to the first axis. When the grip attachment body is received within the first socket, the polymer main body retains the first threaded insert within the slot.

In some embodiments, the first threaded insert has a central axis that is oblique to the first axis.

In some aspects, the lower receiver does not have a minimal wall thickness that is greater than ⅜ inch.

According to some aspects, the polymer main body defines a first transverse through-hole therethrough, and the grip attachment body includes a first transverse through-hole that aligns with the first transverse through-hole of the polymer main body to receive a takedown pin so that receipt of the takedown pin secures the grip attachment body to the polymer main body.

In one example, the polymer main body defines a second transverse through-hole therethrough, and the grip attachment body includes a second transverse through-hole that aligns with the second transverse through-hole of the polymer main body to receive a safety selector.

In some aspects, the lower receiver is configured for use in a modern sporting rifle.

In accordance with various embodiments, the polymer main body defines a through-opening that is configured to receive a core extension tube, and the lower receiver includes a second threaded insert within the through-opening of the polymer main body. In one such embodiment, the second threaded insert is integrally molded with the polymer main body.

In some embodiments, the interior of the polymer main body defines a bolt catch assembly socket. The lower receiver further includes a bolt catch assembly, the bolt catch assembly comprising a bolt catch housing that is receivable into the bolt catch assembly socket of the polymer main body. In one exemplary aspect, the bolt catch housing is formed from metal.

In some aspects, the bolt catch assembly includes a bolt catch and a bolt catch pin. The polymer main body defines a side slot. The bolt catch housing includes a pair of outwardly extending prongs that extend through the side slot. The outwardly extending prongs receive the bolt catch pin about which the bolt catch pivots.

In one aspect, the bolt catch assembly socket includes engagement surfaces that are complementary to at least a portion of the bolt catch housing.

In exemplary aspects, the lower receiver includes a pivot pin housing segment. The polymer main body and the pivot pin housing segment cooperate to define a pivot pin detent opening. In one embodiment, the pivot pin housing segment includes a first hemicylindrical surface. The polymer main body defines a second hemicylindrical surface that cooperates with the first hemicylindrical surface to define the pivot pin detent opening. In some examples, the pivot pin housing segment defines a first pivot pin through-opening. The polymer main body defines a second pivot pin through-opening. The pivot pin housing segment and the polymer main body are configured to simultaneously receive a pivot pin through the first and second pivot pin through-openings to secure the pivot pin housing segment to the polymer main body. In one exemplary embodiment, the pivot pin housing segment and the polymer main body define interlocking features that permit receipt of the pivot pin housing segment with the polymer main body along a longitudinal axis.

According to one aspect of the invention, a lower receiver includes a polymer main body and a pivot pin housing segment. The polymer main body and the pivot pin housing segment cooperate to define a pivot pin detent opening.

According to another aspect of the invention, a lower receiver includes a polymer main body having an outer surface and defining an interior. The interior of the polymer main body defines a bolt catch assembly socket. The lower receiver further includes a bolt catch assembly, the bolt catch assembly including a bolt catch housing that is receivable into the bolt catch assembly socket of the polymer main body.

DETAILED DESCRIPTION

Figure 1:
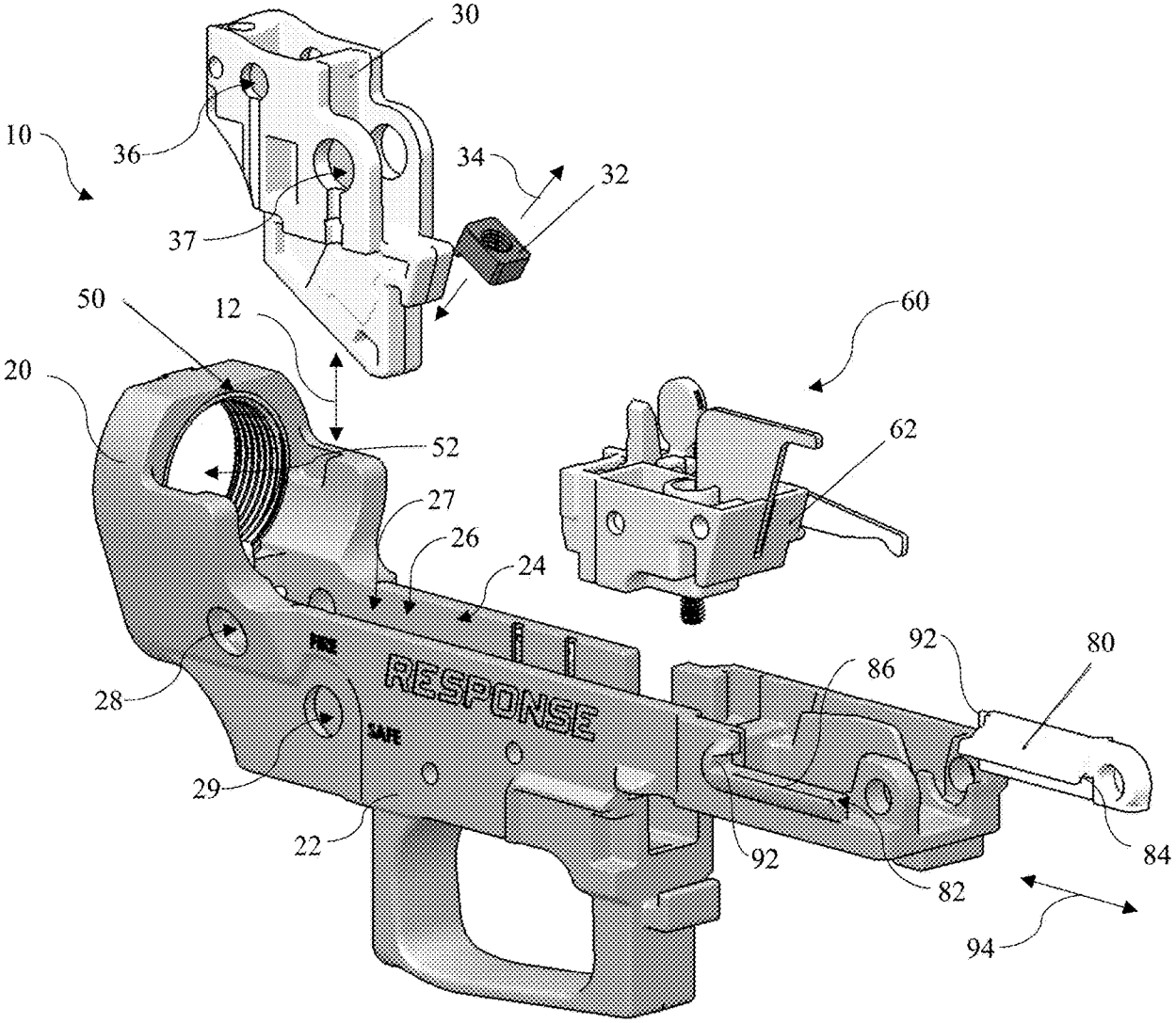
FIG. 1 is an exploded view of an exemplary lower receiver of a firearm as disclosed herein, shown from a front, left-side perspective.
Figure 2:
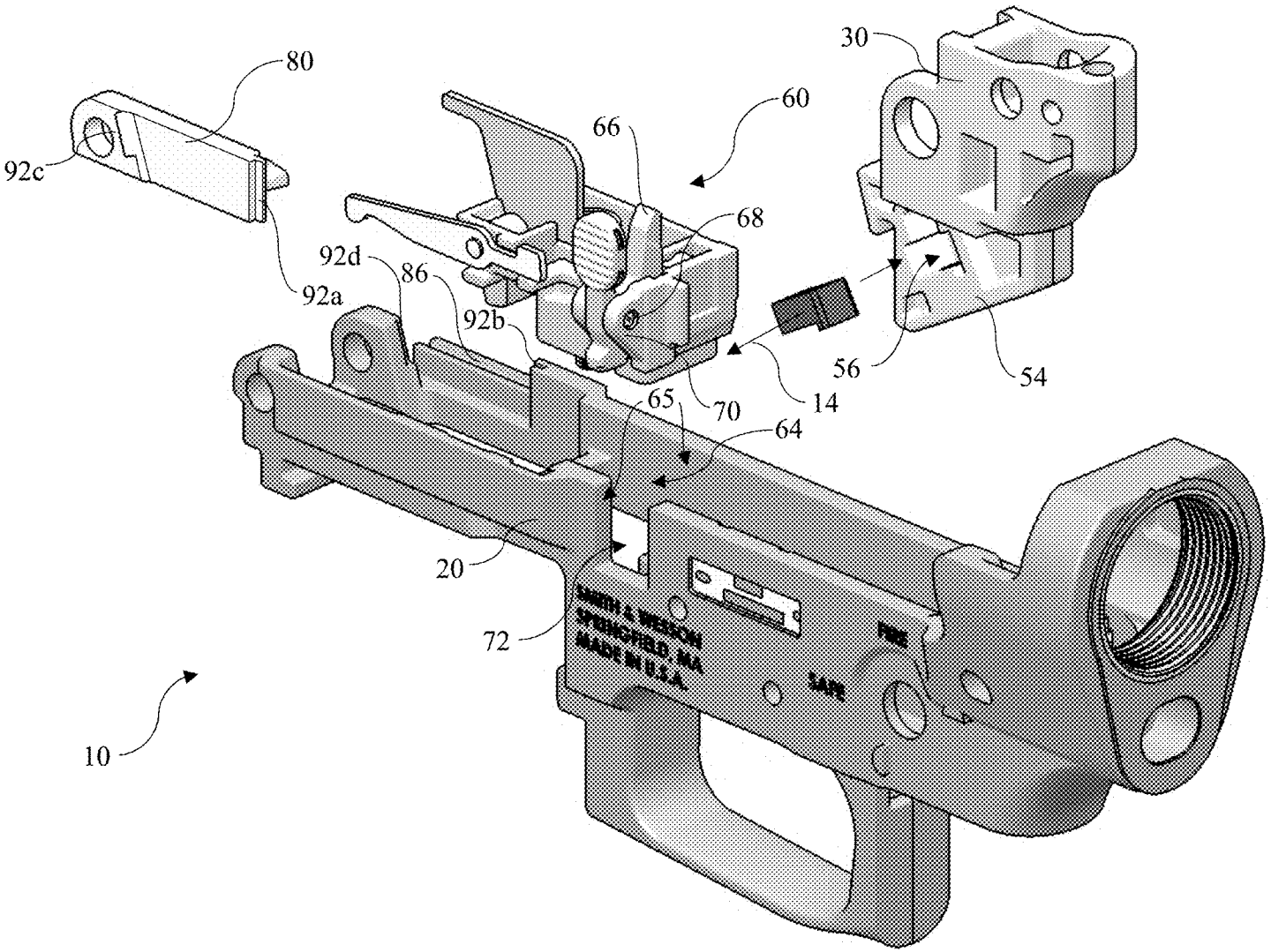
FIG. 2 is the exploded view of the lower receiver of FIG. 1, shown from a rear, right-side perspective.

FIGS. 1-2 are exploded views from opposite sides of a lower receiver according to aspects of this invention. In this example, the lower receiver 10 is depicted as a lower receiver for a semi-automatic rifle 8, however, it is contemplated that other firearm designs and configurations can be compatible with the current disclosure.

The lower receiver 10 comprises a polymer main body 20 and a grip attachment body 30 that cooperates with the polymer main body to retain a first threaded insert 32. The first threaded insert 32 receives a fastener 33 (FIG. 4) for securing a grip to the lower receiver. The polymer main body 20 has an outer surface 22 and defines an interior 24. The interior 24 of the polymer main body 20 defines a first socket 26. The grip attachment body 30 is received along a first axis 12 into the first socket 26 of the interior 24 of the polymer main body 20. The polymer main body 20 comprises engagement surfaces 27 that are complementary to at least a portion of the grip attachment body 30. That is, the engagement surfaces 27, being complementary or substantially complementary to the corresponding portion of the grip attachment body, match or generally match the shape of corresponding surfaces of the grip attachment body 30 facing the engagement surfaces to securely receive the grip attachment body 30 and inhibit relative movement therebetween.

Figure 5:
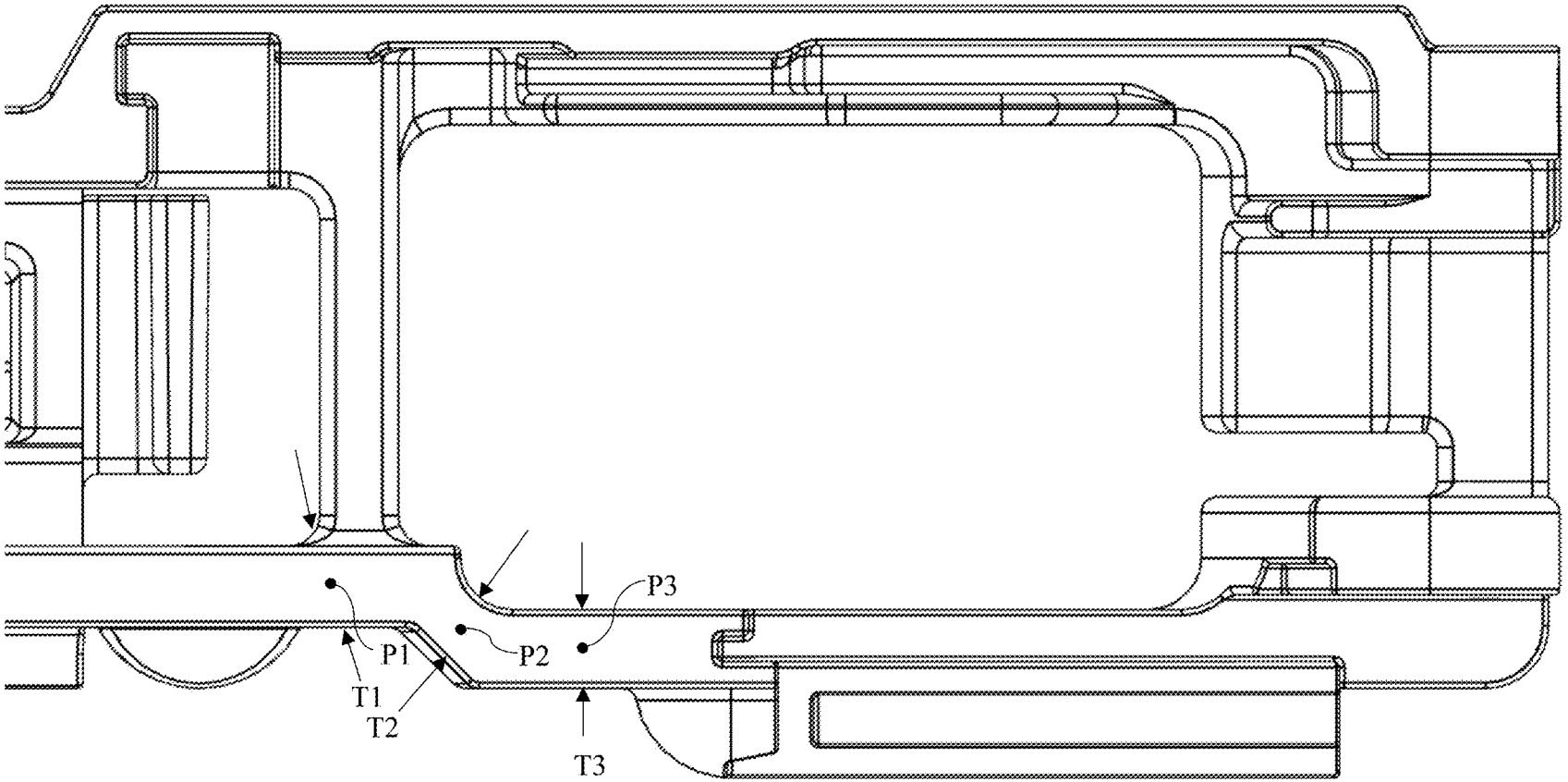
FIG. 5 is a top view of a portion of a polymer main body of the lower receiver of FIG. 1, illustrating measurements of minimum wall thicknesses at different points.

Providing a grip attachment body 30 that is separate from the polymer main body 20 enables assembly of a structure that, if formed from a single unitary structure, would result in sinks, i.e., dips in the surface due to shrinking of the polymer during formation. For example, in some aspects, the lower receiver 10 does not have a minimum wall thickness of greater than ⅜ inch. As used herein, the "minimum wall thickness" at each point within a polymer body is defined as a thickness of material measured between the closest opposing surfaces along an axis (in any orientation) that extends through the point. Accordingly, in these aspects, the minimum wall thickness at each point within the lower receiver 10, defined between the two closest opposing surfaces of the molded component within which the point is located along the axis that extends through said point, is no greater than ⅜ inch. In other aspects, the lower receiver 10 does not have a minimum wall thickness of greater than ½ inch. Accordingly, in these aspects, the minimum wall thickness at each point within the lower receiver 10, defined between the two closest opposing surfaces of the molded component within which the point is located along the axis that extends through said point, is no greater than ½ inch. In other aspects, the lower receiver 10 does not have a minimum wall thickness of greater than 5/16 inch. Accordingly, in these aspects, the minimum wall thickness at each point within the lower receiver 10, defined between the two closest opposing surfaces of the molded component within which the point is located along the axis that extends through said point, is no greater than 5/16 inch. In still further aspects, the minimum wall thickness at each point within the lower receiver 10, defined between the two closest opposing surfaces of the molded component within which the point is located along the axis that extends through said point, is no greater than ¼ inch. FIG. 5 illustrates exemplary minimum wall thicknesses T1, T2, and T3 for different exemplary points P1, P2 and P3 within the polymer main body 20. The grip attachment body 30 has coring that further limits the wall thickness. By providing the coring in the grip attachment body 30, the coring is received within and hidden by the polymer main body 20 for aesthetic purposes.

In this example, and as shown in FIG. 2, the grip attachment body 30 comprises an outer surface 54 that defines a slot 56 that slidably receives the first threaded insert 32 along a second axis 14 that is perpendicular (or, in some optional aspects, within 10 degrees of perpendicular) to the first axis. When the grip attachment body 30 is received within the first socket 20, the polymer main body retains the first threaded insert 32 within the slot 92. The first threaded insert 32 has a central axis 34 that is oblique to the first axis 12.

Figure 4:
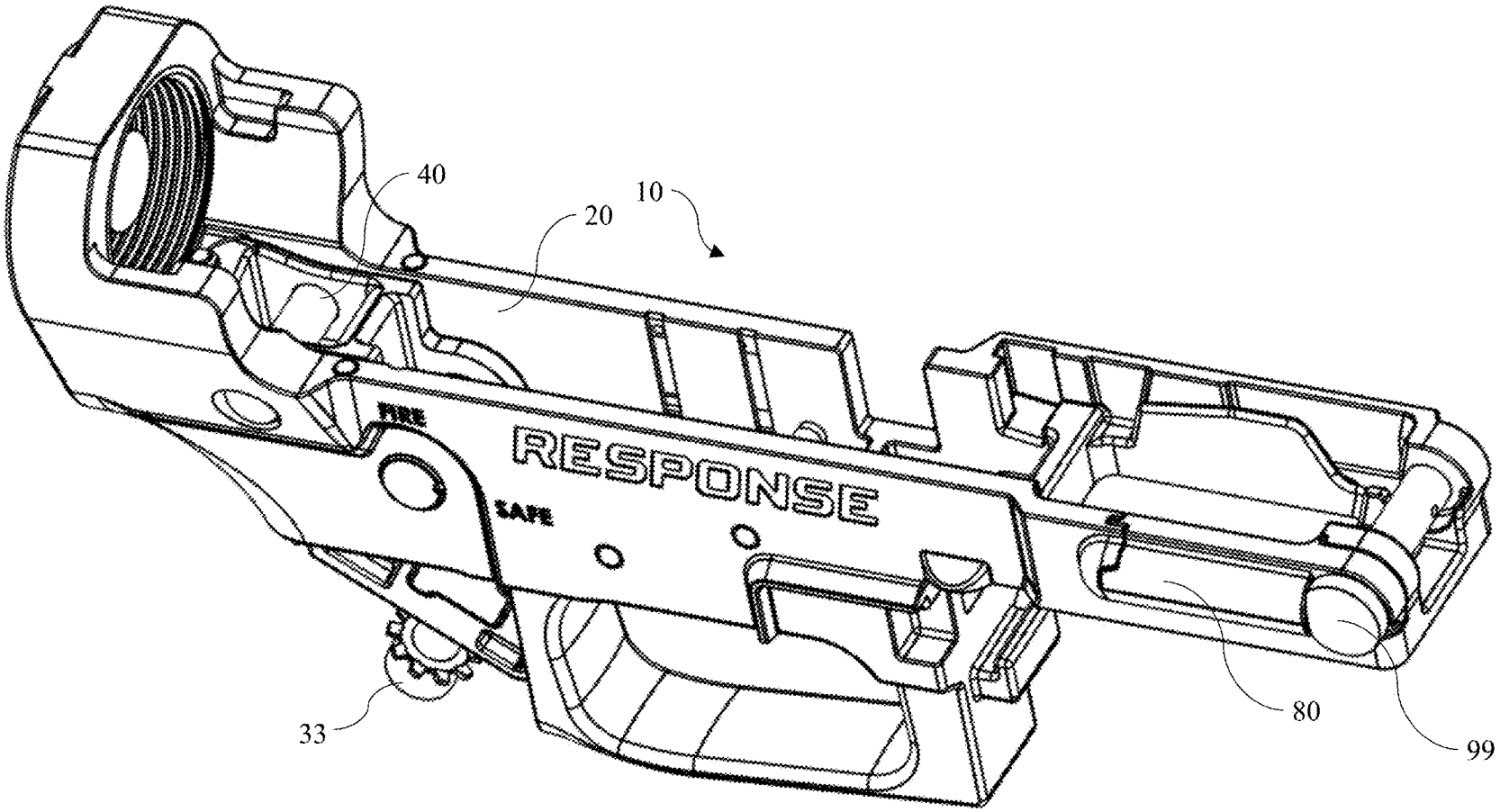
FIG. 4 is an isolated perspective view of various assembled components of the firearm of FIG. 3.

As shown in FIG. 1, the polymer main body 20 defines a first transverse through hole 28 that aligns with a first transverse through-hole 36 through the grip attachment body 30 to cooperatively receive a takedown pin 40 (FIG. 4), thereby securing the grip attachment body 30 to the polymer main body. The polymer main body 20 defines a second transverse through hole 29 that aligns with a first transverse through-hole 37 through the grip attachment body 30 to cooperatively receive therethrough a safety selector (FIG. 4).

Figure 3:
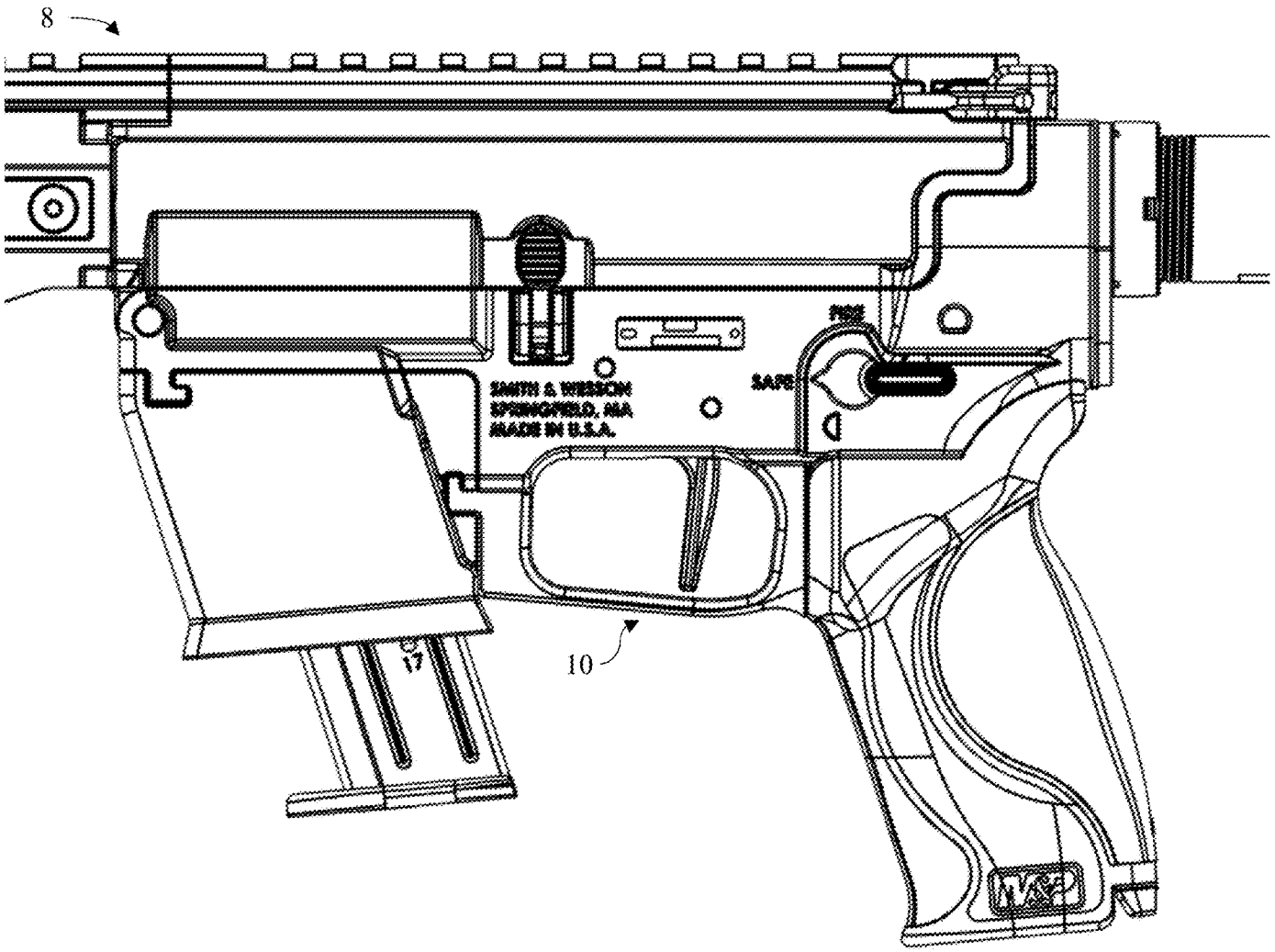
FIG. 3 is a side view of an exemplary firearm including the exemplary lower receiver disclosed herein.

The lower receiver 10 comprises a second threaded insert 50 received within a through-opening 52 of the polymer main body 20. The second threaded insert 50 receives a core extension tube (a portion of which is shown in FIG. 3). Optionally, in this embodiment, the second threaded insert 50 can be integrally molded within the through-opening 52 of the polymer main body 20.

As shown in FIGS. 1-2, the lower receiver 10 comprises a bolt catch assembly 60 that engages a follower of a magazine and, in response, positions a bolt catch 66 to hold a bolt in an open position. A bolt catch housing 62 of the bolt catch assembly 60 is received within a bolt catch assembly socket 64 of the polymer main body 20. The bolt catch assembly socket 64 comprises engagement surfaces 65 that are complementary to at least a portion of the bolt catch housing 62. In this example, the bolt catch housing 62 comprises metal to support the components of the bolt catch assembly 60. The bolt catch 66 is pivotably mounted on a bolt catch pin 68 that is held between a pair of outwardly extending prongs 70 of the bolt catch housing 62. The polymer main body 20 defines a side slot 72 within which the outwardly extending prongs 70 are positioned. Optionally, in this embodiment, the outwardly extending prongs extend 70 extend through the side slot 72.

The lower receiver 10 comprises a pivot pin housing segment 80 that cooperates with the polymer main body 20 to define a pivot pin detent opening 82. The pivot pin housing segment 80 comprises a first surface 84 (FIG. 1), and the polymer main body 20 defines a second surface 86 (FIG. 2) that cooperates with the first surface 84 to define the pivot pin detent opening 82. Optionally, the first and second surfaces 84, 86 can be hemicylindrical. As can be understood, the pivot pin detent opening 82 is a long, narrow passage that is difficult to form via molding and, therefore, would require a separate machining step to form from a single unitary component.

The pivot pin housing segment 80 and the polymer main body 20 define respective interlocking features that permit receipt of the pivot pin housing segment within the polymer main body along a longitudinal axis 94. In this example, the pivot pin housing segment 80 and the polymer main body 20 respectively define a first pair of interlocking features 92*a*, 92*b* and a second pair of interlocking features 92*c*, 92*d*. The pivot pin housing segment 80 defines a first pivot pin through-opening 96, and the polymer main body defines a second pivot pin through-opening 69. The pivot pin housing segment 80 and the polymer main body 20 simultaneously receive a pivot pin 99 (FIG. 4) through the first and second pivot pin through-openings 96, 98 to secure the pivot pin housing segment to the polymer main body. Thus, by receipt of the pivot pin during assembly of the firearm, the pivot pin housing segment 80 is secured to the housing to form the pivot pin detent opening 82.

The disclosed embodiments provide a lower receiver formed substantially from molded polymer components, which can reduce cost and weight over conventional metal lower receivers. By providing a modular assembly, polymer thickness that would otherwise result in sinks can be avoided while still providing the desired structure and aesthetic look. Further, the modularity permits formation of structures that are difficult to form during injection, such as, for example, the pivot pin detent opening. Similarly, the modularity permits use of threaded inserts to thereby reduce molding costs and complexity. Further, the modular components described herein can be coupled together without use of additional fasteners. For example, the pivot pin housing segment 80 can be secured to the polymer main body 20 by a pivot pin that is used in non-polymer lower receivers. Additionally, the modular assembly permits use of metal components, such as, in some embodiments, the threaded inserts and bolt catch housing 62 that advantageously provide durability.

What is claimed is:

1. A lower receiver comprising:

a polymer main body having an outer surface and defining an interior, wherein the interior of the polymer main body defines a first socket and a bolt catch assembly socket;

a grip attachment body that is receivable, along a first axis, into the first socket of the interior of the polymer main body, wherein the grip attachment body comprises a first threaded insert that is configured to receive a fastener for securing a grip to the lower receiver; and a bolt catch assembly, the bolt catch assembly comprising a bolt catch housing that is receivable into the bolt catch assembly socket of the polymer main body.

2. The lower receiver of claim 1, wherein the first socket comprises engagement surfaces that are complementary to at least a portion of the grip attachment body.

3. The lower receiver of claim 1, wherein the grip attachment body comprises an outer surface that defines a slot, wherein the first threaded insert is slidably received within the slot along a second axis that is perpendicular to the first axis, wherein, when the grip attachment body is received within the first socket, the polymer main body retains the first threaded insert within the slot.

4. The lower receiver of claim 1, wherein the first threaded insert has a central axis that is oblique to the first axis.

5. The lower receiver of claim 1, wherein the lower receiver does not have a minimum wall thickness that is greater than ⅜ inch.

6. The lower receiver of claim 1, wherein the polymer main body defines a first transverse through-hole therethrough, wherein the grip attachment body comprises a first transverse through-hole that aligns with the first transverse through-hole of the polymer main body to receive a takedown pin, wherein receipt of the takedown pin secures the grip attachment body to the polymer main body.

7. The lower receiver of claim 6, wherein the polymer main body defines a second transverse through-hole therethrough, wherein the grip attachment body comprises a second transverse through-hole that aligns with the second transverse through-hole of the polymer main body to receive a safety selector.

8. The lower receiver of claim 1, wherein the lower receiver is configured for use in a semi-automatic rifle.

9. The lower receiver of claim 1, wherein the polymer main body defines a through-opening that is configured to receive a core extension tube, wherein the lower receiver comprises a second threaded insert within the through-opening of the polymer main body.

10. The lower receiver of claim 9, wherein the second threaded insert is integrally molded with the polymer main body.

11. The lower receiver of claim 1, wherein the bolt catch housing comprises metal.

12. The lower receiver of claim 1, wherein the bolt catch assembly comprises a bolt catch and a bolt catch pin, wherein the polymer main body defines a side slot, wherein the bolt catch housing comprises a pair of outwardly extending prongs that extend through the side slot, wherein the outwardly extending prongs receive the bolt catch pin about which the bolt catch pivots.

13. The lower receiver of claim 1, wherein the bolt catch assembly socket comprises engagement surfaces that are complementary to at least a portion of the bolt catch housing.

14. The lower receiver of claim 1, further comprising a pivot pin housing segment, wherein the polymer main body and the pivot pin housing segment cooperate to define a pivot pin detent opening.

15. The lower receiver of claim 14, wherein the pivot pin housing segment comprises a first hemicylindrical surface, wherein the polymer main body defines a second hemicylindrical surface that cooperates with the first hemicylindrical surface to define the pivot pin detent opening.

16. The lower receiver of claim 14, wherein the pivot pin housing segment defines a first pivot pin through-opening, wherein the polymer main body defines a second pivot pin through-opening, wherein the pivot pin housing segment and the polymer main body are configured to simultaneously receive a pivot pin through the first and second pivot pin through-openings to secure the pivot pin housing segment to the polymer main body.

17. The lower receiver of claim 14, wherein the pivot pin housing segment and the polymer main body define interlocking features that permit receipt of the pivot pin housing segment with the polymer main body along a longitudinal axis.

18. A lower receiver comprising:

a polymer main body; and a pivot pin housing segment, wherein the polymer main body and the pivot pin housing segment cooperate to define a pivot pin detent opening, wherein the pivot pin housing segment defines a first pivot pin through-opening, wherein the polymer main body defines a second pivot pin through-opening, wherein the pivot pin housing segment and the polymer main body are configured to simultaneously receive a pivot pin through the first and second pivot pin through-openings to secure the pivot pin housing segment to the polymer main body.

* * * * *